United States Patent [19]

Tzong

[11] Patent Number: 4,807,460

[45] Date of Patent: Feb. 28, 1989

[54] RIVETER WITH ADJUSTABLE HEADPIECE

[76] Inventor: Liou C. Tzong, No. 45, Lane 114, Kang-Tzeng Road, Ta-Li Hsian, Taichong Hsien, Taiwan

[21] Appl. No.: 26,768

[22] Filed: Mar. 17, 1987

[51] Int. Cl.[4] ..... B21J 15/34

[52] U.S. Cl. ..... 72/391; 29/243.53

[58] Field of Search ..... 72/391, 114, 409; 29/243.53, 243.5

[56] References Cited

U.S. PATENT DOCUMENTS 4,344,311 8/1982 Inoue ..... 72/391
4,347,729 9/1982 Mitani ..... 72/391
4,351,179 9/1982 Fiebiger ..... 72/391
4,353,239 10/1982 Fujimoto ..... 72/391

FOREIGN PATENT DOCUMENTS 232643 12/1984 Japan ..... 72/391
40641 3/1985 Japan ..... 72/391

*Primary Examiner*—David Jones
*Attorney, Agent, or Firm*—Bacon & Thomas

[57] ABSTRACT

An adjustable riveter including a headpiece, an actuator, a pressing handle, a fixed handle, and an adjusting cam which permits changing the angle of the rivet headpiece to dispose same in either a crank or straight position of operation.

1 Claim, 5 Drawing Sheets

RIVETER WITH ADJUSTABLE HEADPIECE

BACKGROUND OF THE INVENTION

1. Field of the Invention

Riveters have been used by woodworkers to combine layers of plywood or thin alloy plates. Basically, a conventional riveter sets a pin and a sleeve through a punch hole between the plates to combine same together by pulling and punching procedures.

2. Description of Prior Art

Conventionally, there are two types of riveters, including the crank type and the straight type.

The crank type is used for riveting horizontal and vertical surfaces while the straight type is for overhead or difficult to reach applications. Thus, it is often necessary to carry both types of riveters during a given job.

SUMMARY OF THE INVENTION

It is an object of the invention to provide a single riveter capable of performing all required riveting functions.

This is realized by providing an adjustable riveter having a riveting head-piece, an actuator block, a pressing handle, a fixed handle and an angle-adjusting cam actuator so as to permit the angle of the headpiece to be adjusted to the specific job requirement.

DETAILED DESCRIPTION OF THE PREFERRED EMBODIMENT

Figure 1:
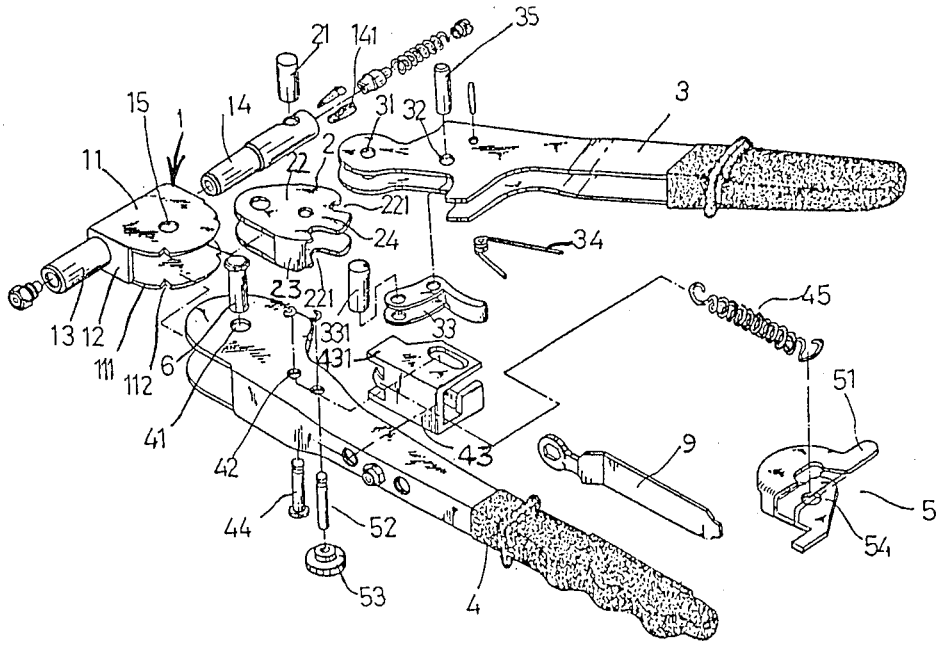
FIG. 1 is an exploded perspective view of a riveter according to a preferred embodiment of the invention.

A riveter according to the invention is shown in FIG. 1 as including a riveting head-piece (1) having two side plates (11) and (111). A connection piece (12), a sleeve holder (13), and a sleeve tube (14) engaged by tooth plate 141. On the edges of the side plates (11) and (111), there are provided opposed 90° notches (112) and opposed master corresponding pin holes (15) in the side plates (11) and (111) of the headpiece (1).

A cam actuator (2) having two opposed side plates (22) and a connection piece (23) is joined with sleeve tube (14) by a master pin (21). A pair of conventional jaws (141) received within tube (14). On corresponding edges of the side plates (22) are provided opposed openings (221), and a master pin hole (24) is provided at the center of each side plate (22).

A pressing handle (3) includes a pin hole (31) in each of two opposed fork plates and a pin hole (32) at the back part of the fork for securing an angle-adjusting plate (33) by a pin (35), with plate (33) being engageable by a wire spring (34), which spring (34) biases plate (33) away from handle (3). A pin (331) is engaged within opposed openings (221).

A fixed handle (4) with a fork head is secured to the rivet headpiece (1) by a master pin (6) through pinhole (41). Another pinhole (42) is provided in the block piece (43) for receiving a block piece shaft (44). The block piece (43) is inserted between the notches (112) and actuated by a spring (45) at the top end.

An adjusting cam (5) includes an actuator plate (51) joined with an adjustable knob (53) by a cam shaft (52) for angle selection.

When the abovementioned parts and components are fully assembled, the angle-adjusting plate (33) will be disposed inside the pressing handle (3), the front part of pressing handle (3) will be set inside the actuator (2) and joined with the sleeve tube (14) inside the rivet head. Pin (331) is inserted in openings (221) and the adjusting cam (5) is placed inside the fixed handle (4) together with the block piece (43). The front part of the fixed handle (4) will accommodate the rivet head (1) with the front plate (431) inserted inside the notches (112). At this position, master pin (6) is received through the fixed handle (4), rivet head (1), actuator (2), and the pin holes (41, 15, 24, 31) of the pressing handle (3) for corresponding operation.

Figure 2:
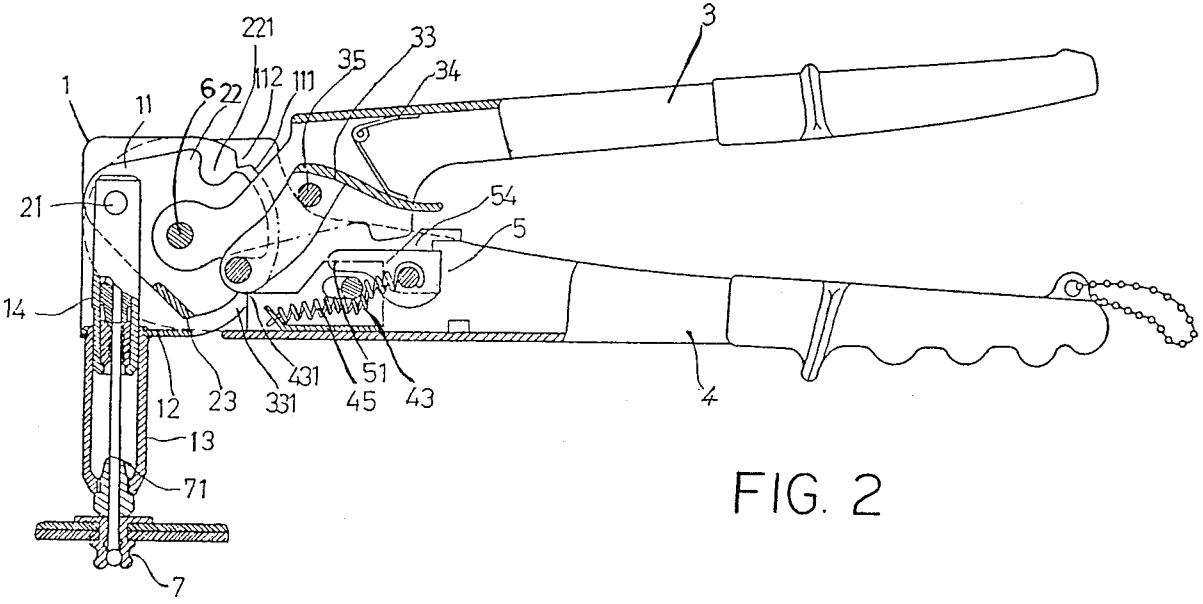
FIG. 2 is a plan view, partly in section, showing the riveter of FIG. 1 in a crank position of operation.

Therefore, when the riveter is to be used in a crank position as shown in FIG. 2, a force is applied from the back part of pressing handle (3) to bring down pin (35) and turn the actuator (2) about pin (331), thereby raising the master pin (21) together with sleeve tube (14) and bring up the shaft (71) rivet (7) to perform the riveting operation.

Figure 3:
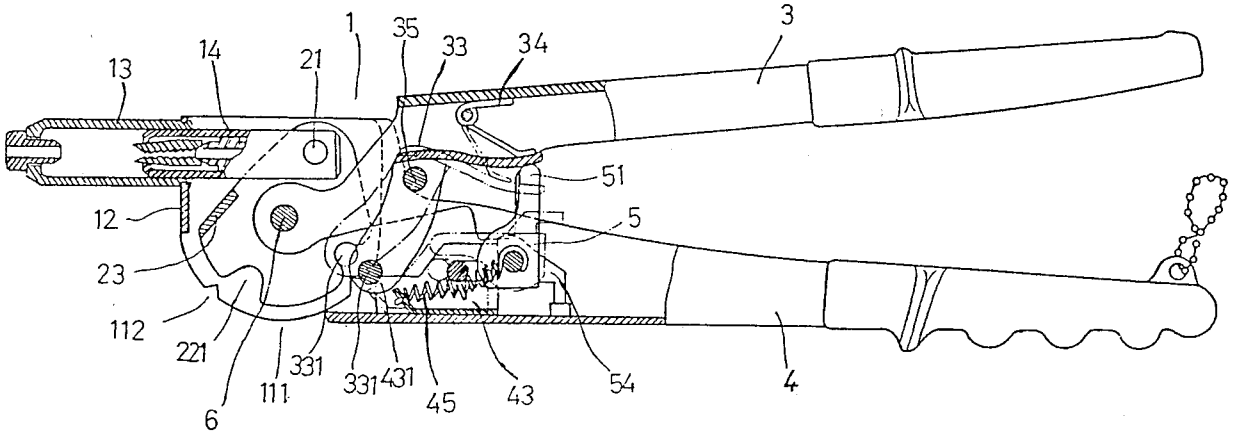
FIG. 3 is a plan view, partly in section, showing the riveter of FIG. 1 in a straight position of operation.

On the other hand, when the adjustable knob (53) is turned to set the camshaft (5) at a certain angle, the actuator plate (51) will push the back part of the angle-adjusting plate (33) and make pin (331) move out from openings (221) and free the actuator (2) from pin (331). Because of the restoration force of spring (45), the block piece (431) will also move out from notches (112) and free the rivet head (1) from the block piece (43). At this junction, using the master pin (6) as a major axis, rivet head (1) an actuator (2) may be turned to the desired angle. The sleeve-holder (13) may be turned to accommodate the sleeve tube (14) and place the actuator in a proper position. Since the adjusting cam (5) is restored to the original position, no supporting force is imparted to the angle-adjusting place (33), and pin (331) shall go into openings (221), with block piece (431) also trapped in notches (112) because of extension force from spring (45) through the support of the exposed edge (54). This serves to dispose the riveter in the straight position as shown in FIG. 3.

The pressing handle (4) may still complete the riveting operation through angle-adjusting plate (33), actuator (2) and sleeve tube (14) as mentioned above.

Figure 4:
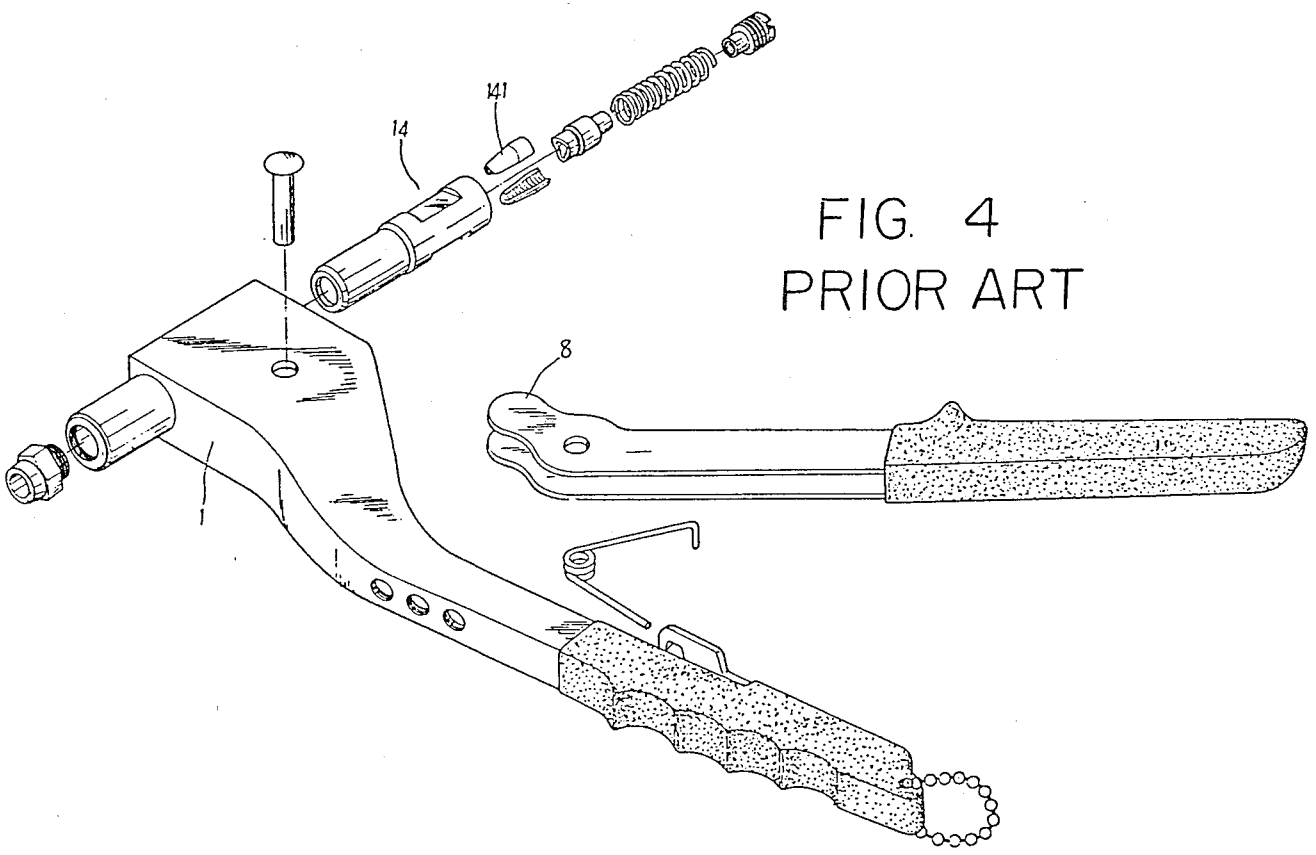
FIG. 4 PRIOR ART
FIG. 4 is an exploded perspective view of a conventional crank type riveter.
Figure 5:
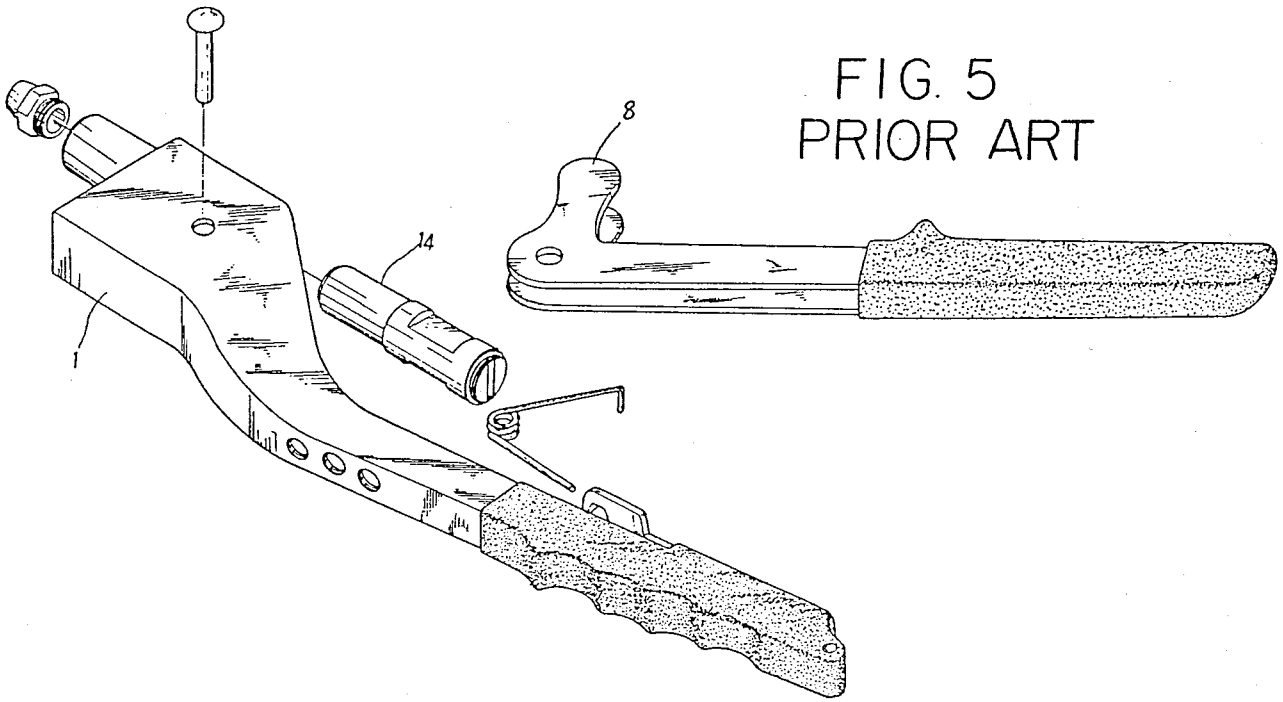
FIG. 5 PRIOR ART
FIG. 5 is an exploded perspective view of a conventional straight type riveter.

A spanner wrench (9) may be used for adjusting knob (53). As stated above, this invention can change the head angle of a riveter by using an adjusting cam (5). The normal operation of conventional riveters shown in FIGS. 4 and 5 is well known and need not be detailed herein.

I claim:

1. An adjustable riveter comprising:

(a) a riveting headpiece (1) including a pair of opposed side plates (11), a connection piece (12) joining the side plates (11), a sleeve holder (13) extending from the connection piece (12), a sleeve tube (14) engageable within the sleeve holder (13), and first and second pairs of 90° notches (112) formed in spaced corresponding edge portions of the side plates (11);

(b) a cam actuator (2) including a pair of opposed side plates (22), first and second pairs of openings (221)

formed in spaced corresponding edge portions of the side plates (22), and a first master pin (21) securing the sleeve tube (14) to the cam actuator (2);

(c) a pressing handle (3);

(d) an angle-adjusting plate (33) pivotally secured to the pressing handle (3) the plate (33) including a pin (331) for selective engagement within the first and second pairs of openings (221) and a spring (34) biasing the plate (33) away from handle (3);

(e) a fixed handle (4) including a fork head;

(f) a second master pin (6) pivotally securing the headpiece (1), cam actuator (2) and pressing handle (3) to the fork head of the fixed handle (4);

(g) a blockpiece (43) carried by the fixed handle (4) for selective engagement within the first and second pairs of notches (112) and a spring (45) biasing the blockpiece (43) away from notches (112); and (h) an adjustable cam (5) carried by the fixed handle (4) for engaging the angle-adjusting plate (33) to disengage the pin (331) from the first or second pair of openings (221) and simultaneously disengage the blockpiece (431) from the first or second pair of notches (112); thereby permitting selective disposition of the headpiece (1) into either a crank position wherein the pin (331) and the blockpiece (431) are engaged within, respectively, the first pair of openings and the first pair of notches or a straight position wherein the pin (331) and the blockpiece (431) are engaged within, respectively, the second pair of openings and the second pair of notches.

* * * * *